US010107494B2

(12) United States Patent
Blum et al.

(10) Patent No.: US 10,107,494 B2
(45) Date of Patent: Oct. 23, 2018

(54) SYSTEM AND METHOD FOR GENERATING FLAME EFFECT

(71) Applicant: Universal City Studios LLC, Universal City, CA (US)

(72) Inventors: Steven C. Blum, Orlando, FL (US); Benjamin Robert Clark, Wexford, PA (US)

(73) Assignee: Universal City Studios LLC, Universal City, CA (US)

( * ) Notice: Subject to any disclaimer, the term of this patent is extended or adjusted under 35 U.S.C. 154(b) by 824 days.

(21) Appl. No.: 14/258,981

(22) Filed: Apr. 22, 2014

(65) Prior Publication Data

US 2015/0300635 A1 Oct. 22, 2015

(51) Int. Cl.

| | |
|---|---|
| ***F23D 14/34*** | (2006.01) |
| ***F23D 17/00*** | (2006.01) |
| ***F23D 14/58*** | (2006.01) |
| ***A63J 5/02*** | (2006.01) |
| ***F23N 5/08*** | (2006.01) |
| ***F23D 14/38*** | (2006.01) |

(52) U.S. Cl.

CPC ..... *F23D 14/34* (2013.01); *A63J 5/023* (2013.01); *F23D 14/38* (2013.01); *F23D 14/58* (2013.01); *F23D 17/00* (2013.01); *F23N 5/08* (2013.01); *F23D 2206/00* (2013.01); *F23N 2029/04* (2013.01); *F23N 2037/08* (2013.01)

(58) Field of Classification Search

CPC ..... F23N 5/08; F23N 2029/04; F23D 17/002; F23D 14/34; F23D 14/38; F23D 14/52; A63J 5/023

USPC ..... 431/12

See application file for complete search history.

(56) References Cited

U.S. PATENT DOCUMENTS

| | | | | |
|---|---|---|---|---|
| 2,270,442 A | | 1/1942 | Jares | |
| 2,502,604 A | * | 4/1950 | Tanner | F23D 14/38 239/427 |
| 2,598,787 A | * | 6/1952 | Haak | F23D 14/38 239/416.4 |
| 2,642,656 A | * | 6/1953 | Grosse | B23K 35/38 148/194 |
| 3,489,108 A | | 1/1970 | Garver et al. | |
| 4,173,499 A | | 11/1979 | Holemann | |
| 5,478,232 A | * | 12/1995 | Dillinger | F21S 13/10 431/100 |

(Continued)

FOREIGN PATENT DOCUMENTS

| | | |
|---|---|---|
| CN | 1986078 A | 6/2007 |
| CN | 101274710 A | 10/2008 |

(Continued)

OTHER PUBLICATIONS

PCT International Search Report and Written Opinion dated Jul. 31, 2015.

*Primary Examiner* — Avinash Savani
*Assistant Examiner* — Martha Becton
(74) *Attorney, Agent, or Firm* — Fletcher Yoder, P.C.

(57) ABSTRACT

Present embodiments are directed to a system and method for generating a flame effect. An embodiment includes a nozzle assembly with an outer nozzle and an inner nozzle. At least a portion of the inner nozzle is nested within at least a portion of the outer nozzle. The system also includes a fuel source with two or more separate types of fuel.

21 Claims, 7 Drawing Sheets

(56) References Cited

U.S. PATENT DOCUMENTS

| | | | | | |
|---|---|---|---|---|---|
| 5,587,283 | A | * | 12/1996 | Karinthi | C03B 5/2353 431/10 |
| 5,636,978 | A | * | 6/1997 | Sasaki | F23N 5/203 431/18 |
| 5,756,920 | A | * | 5/1998 | Fleming | F41H 9/02 431/1 |
| 5,834,066 | A | * | 11/1998 | Kunzli | C23C 4/129 239/79 |
| 2004/0018317 | A1 | | 1/2004 | Heinrich et al. | |
| 2004/0166247 | A1 | | 8/2004 | Heinrich et al. | |
| 2010/0032020 | A1 | | 2/2010 | Labegorre et al. | |
| 2013/0040255 | A1 | | 2/2013 | Shi et al. | |
| 2013/0058772 | A1 | | 3/2013 | Heinrich et al. | |

FOREIGN PATENT DOCUMENTS

| | | | |
|---|---|---|---|
| CN | 201136703 | Y | 10/2008 |
| DE | 4025808 | | 1/1991 |
| DE | 4434944 | A1 | 4/1996 |
| DE | 102007038024 | A1 | 2/2009 |
| DE | 102009009474 | A1 | 8/2010 |
| GB | 1138311 | A | 1/1969 |
| JP | 2007192485 | A | 8/2007 |
| JP | 2007003147 | | 11/2007 |
| JP | 2008116077 | A | 5/2008 |
| KR | 20130072750 | | 7/2013 |
| RU | 2013698 | C1 | 5/1994 |
| RU | 2315239 | C1 | 1/2008 |
| RU | 2345279 | C2 | 1/2009 |
| WO | 2004/094903 | | 4/2004 |

* cited by examiner

SYSTEM AND METHOD FOR GENERATING FLAME EFFECT

BACKGROUND

The present disclosure relates generally to flame effects and, more particularly, to a system and method for generating flame effects using a fuel nozzle system.

Flame effects (e.g., visible flame outputs) are used to provide an aesthetic display for patrons and others across a wide variety of applications and industries, including in the fireworks industry, the service industry (e.g., restaurants, movie theaters), and in amusement parks, among others. Flame effects generally include ignition and/or burning of one or more fuels. For example, a torch displayed in a restaurant may include a wick that is soaked in a fuel (e.g., kerosene) configured to burn upon ignition. The burning kerosene and wick may produce a flame effect that releases ambient light for patrons in the restaurant.

Flame effects may be more aesthetically appealing and impressive when they are large and colorful. For example, a flame effect with a large, orange flame may be more appealing and impressive than a flame effect with a small, light-yellow flame. Further, a small, light-yellow flame may not be visible, fully or partially, in outdoor applications on a bright afternoon. Indeed, in outdoor applications in particular, flame effects may be visibly different at different times of the day or year depending on environmental factors (e.g., sunlight, weather, pollution, wind conditions). Unfortunately, colorful flame effects generally coincide with incomplete combustion, and incomplete combustion generally results in pollution via residual materials (e.g., pollutants) commonly referred to as soot or ash. Thus, it is now recognized that there exists a need for improved systems and methods for generating flame effects that balance cleanliness, efficiency, and coloration, such that the flame effects are aesthetically appealing, clean burning, cost-effective, clearly visible at any given time during operation, and adaptable to environmental factors.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one aspect of the present disclosure, a system includes a nozzle assembly with an outer nozzle and an inner nozzle. At least a portion of the inner nozzle is nested within at least a portion of the outer nozzle. The system also includes a fuel source with two or more separate types of fuel.

In accordance with another aspect of the present disclosure, a system includes an automation controller configured to regulate a fuel source to control a fluid flow from the fuel source to a first nozzle and to a second nozzle of a nozzle assembly based on environmental factors surrounding the system.

In accordance with another aspect of the present disclosure, a method of operating a system includes determining environmental factors around the system and fluidly coupling a first type of fuel from a fuel source that has two or more separate fuel types with a first nozzle and a second type of fuel from the fuel source with a second nozzle. The method of operation also includes passing the first type of fuel through the first nozzle at a first pressure, passing the second type of fuel through the second nozzle at a second pressure, and passing the first type of fuel and the second type of fuel over an ignition feature, such that the first type of fuel and the second type of fuel ignite to generate a flame effect.

Subsystems and components that make up the flame effect system include various features that individually or cooperatively enable efficient utilization of fuel, control and management of flame characteristics, relative positioning of flame elements, control of flame features based on environmental conditions, control of associated debris (e.g., soot and ash), and enhanced operational characteristics. These different features and their specific effects are described in detail below.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Presently disclosed embodiments are directed to systems and methods for generating and controlling flame effects that may be aesthetically appealing, clearly visible during operation, substantially clean burning, cost-effective, and adaptable to environmental factors (e.g., sunlight, weather, pollution, wind conditions). Presently disclosed embodiments include systems and methods that utilize nozzle assemblies with nested nozzles that facilitate providing desired flame characteristics. For example, present embodiments may control the quantities of fuel, pressures of fuel, types of fuel, and so forth that flow through the various nozzles of a nested nozzle assembly to achieve certain flame characteristics (e.g., projection distance, arrangement of gas envelopes, visibility, soot content, soot scattering patterns). Present embodiments may include or employ converging-diverging nozzles (e.g., de Laval nozzles) with nozzle assemblies for generating flame effects to encourage specific flame characteristics. For simplicity, the converging-diverging nozzles may be referred to herein as "Laval nozzles". It should be noted, however, that embodiments of the present disclosure encompass any converging-diverging nozzles configured to accelerate gas through such nozzles.

Figure 1:
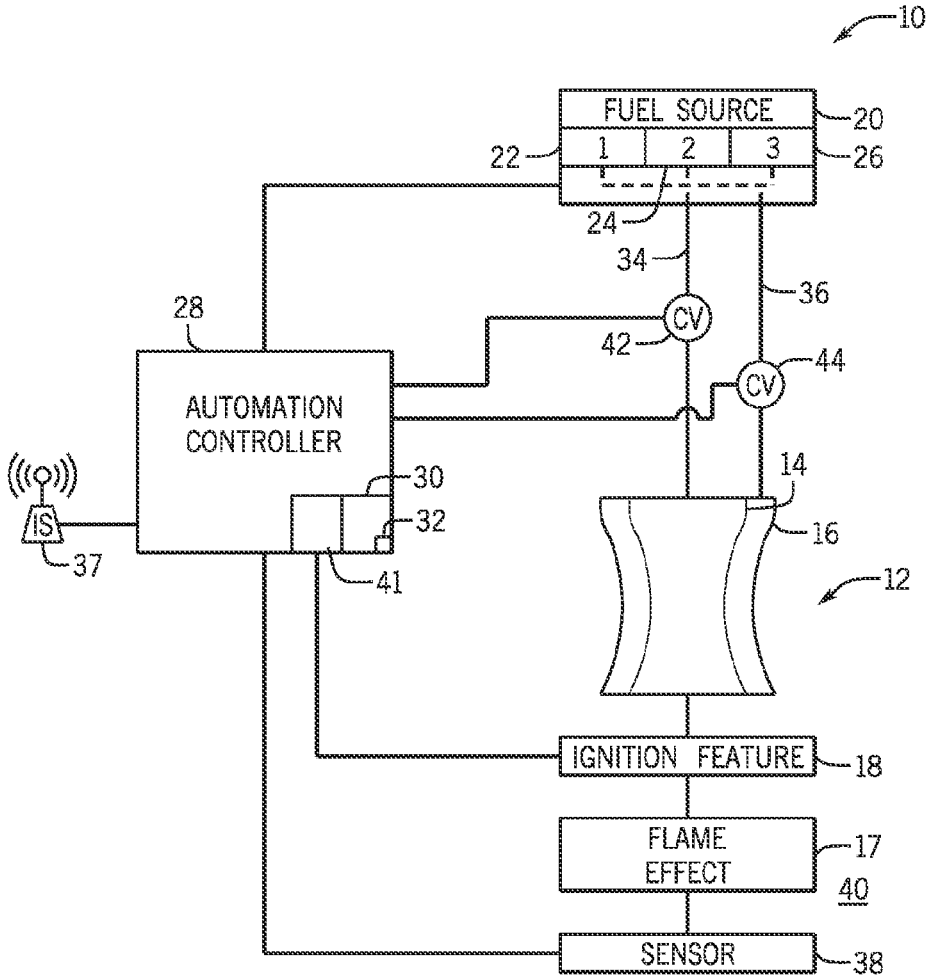
FIG. 1 is a schematic block diagram of an embodiment of a flame effect system including a nozzle assembly and controls system, in accordance with the present disclosure.

Turning first to FIG. 1, a schematic block diagram is shown that includes an embodiment of a flame effect system 10 in accordance with the present disclosure. The system 10 may include, among other things, a nozzle assembly 12. In the illustrated embodiment, the nozzle assembly 12 includes an inner nozzle 14 and an outer nozzle 16, where at least a portion of the inner nozzle 14 is nested within and generally concentric with at least a portion of the outer nozzle 16. In one embodiment, the inner and outer nozzles 14, 16 may include portions that are axially symmetric and/or planar symmetric, but are not entirely concentric. In embodiments in accordance with the present disclosure, the nozzle assembly 12 is configured to produce a flame effect 17 (e.g., plume of fire) that is clearly visible and adaptable to environmental factors.

The nozzle assembly 12 in the illustrated embodiment is configured to produce the flame effect 17 by accelerating or passing fuels (e.g., gaseous or substantially gaseous fuels) through the inner nozzle 14 and the outer nozzle 16. In some embodiments, a regulation device may regulate pressure (and, thus, flow rate) and/or temperature of the fuels (e.g., prior to reaching the nozzles 14, 16), such that the fuels are delivered to the nozzles 14, 16 at a high enough flow rate to enable the fuels to accelerate or pass through and, in some embodiments, mix within the nozzle assembly 12. For example, in one embodiment, the inner nozzle 14 and the outer nozzle 16 may each include a converging portion and a diverging portion. The converging and diverging portions may be configured to accelerate the gases through the nozzles 14, 16. In another embodiment, the nozzles 14, 16 may only include a converging portion or the nozzles 14, 16 may only include a diverging portion. In either embodiment, the nozzles 14, 16 are each configured to restrict a path through which fuel gas or gases flow, such that operational pressures of the flame effect system 10 (e.g., pressures supplied by the regulation device) may be minimized while still passing the gases through, and mixing the gases within, each of the nozzles 14, 16. Further, the inner nozzle 14 may terminate within the outer nozzle 16, such that gas flowing through the enter nozzle enters into a central portion of the outer nozzle 16. Depending on the embodiment, the gases may remain substantially separate within the outer nozzle 16, or the gases may mix within the outer nozzle 16. Such embodiments will be discussed in detail below with reference to later figures. It should be noted that in some embodiments, fluid (e.g., gases) other than fuel may be used to produce different effects (e.g., a fog related effect). Also, some embodiments may use both fuel and non-fuel fluids. Fuel gas is often used as a specific example in the present disclosure, but it should be understood that other fluids may be employed.

After passing through the nozzles 14, 16 (or before acceleration in some embodiments), the gaseous fuels are ignited to produce the flame effect 17. In the illustrated embodiment of FIG. 1, the gaseous fuels pass through the nozzles 14, 16, exit the nozzle assembly 12 at high speeds and pass over an ignition feature 18 (e.g., an igniter), which includes a pilot light that lights or ignites the gaseous fuels as they pass the pilot light to produce the flame effect 17. The flame effect 17 is carried a distance away from the nozzle assembly 12 due to the speed at which the hot gaseous fuels exit the nozzle assembly 12. Further, the flame effect 17 may include specific characteristics based on various factors. For example, the contours of the flow paths in the nozzles 14, 16 of the nozzle assembly 12, the type of fuel used, which nozzle 14, 16 the different types of fuel are supplied through, the pressure of the fuel, and so forth define characteristics of the flame effect 17, as will be discussed in detail below.

In the illustrated embodiment of FIG. 1, the system 10 includes a fuel source 20 which includes gaseous fuels that are accelerated through the nozzle assembly 12, as described above. The fuel source 20 may include multiple compartments or tanks (e.g., a first tank 22, a second tank 24, and a third tank 26), and each tank may include a different type of fuel. One or more (or all) of the tanks may include combustible fuel and one or more of the tanks may include non-combustible material or some other fluid (e.g., oxidant, inert gas, or diluents). For example, the first tank 22 in the illustrated embodiment may include propane, the second tank 24 may include natural gas, and the third tank 26 may include nitrogen or some other inert gas. However, in another embodiment, one or more of the tanks may include some other type of fuel or fluid not listed above, such as oxygen.

Further, an automation controller 28, which includes a processor 30 and a memory 32, may provide outputs that initiate fluidly coupling of one of the tanks 22, 24, 26 with a fluid passageway for either one of the inner or outer nozzles 14, 16, as described above. In the illustrated embodiment, one of the tanks 22, 24, 26 may be placed in fluid communication with a fluid passageway 34 of the inner nozzle 14 and another one of the tanks may be placed in fluid communication with a fluid passageway 36 of the outer nozzle 16. For example, the automation controller 28 may operate to place the first tank 22 having a propane supply in fluid communication with the fluid passageway 36 of the outer nozzle 16 and to place the second tank 24 having natural gas supply in fluid communication with the fluid passageway 34 of the inner nozzle 14. The automation controller 28 may provide outputs based on one or more control algorithms that take into account one or more input values (e.g., manual inputs, sensor measurement values, data feeds). For example, in the illustrated embodiment, the automation controller 28 receives input from an Internet system 37, which is merely one example of a communication network, a sensor 38 disposed in an environment 40 proximate the flame effect 17, or both. Further, the inputs into the automation controller 28 may be analog, digital, or both. The Internet system 37 (or a different communication network) and the sensor 38, or some other device or input to the automation controller 28, provide the automation controller 28 with information relating to environmental factors in the environment 40. For example, the environmental factors may include brightness, pollution, sunlight, weather, time of day, humidity, wind conditions, soot levels from the flame effect 17 or some other environmental factor. In some embodiments, each of the inner nozzle 14 and the outer nozzle 16 may include its own corresponding fuel source, automation controller, sensors, Internet system, program, and/or memory. Further, in some embodiments, more than two nested nozzles or sets of nested nozzles may be employed.

The automation controller 28 may include a burner controller 41 in addition to the processor 30. The burner controller 41 is configured to initiate an ignition sequence upon receiving a trigger signal from the processor 30. The burner controller 41 ignites the ignition features 18 (e.g., an igniter), confirms ignition of the ignition feature 18, and then proceeds to release the fuel from the fuel source 20 to the nozzles 14, 16, which consequently ignites the fuels to generate the flame effect 17. The processor 30 may then analyze all incoming information (e.g., digital or analog signals from the sensor 38, the Internet system 37, or some other input) and determine whether to signal the burner controller 41 to begin the ignition sequence again.

The processor 30 (e.g., of the automation controller 28), which may represent multiple processors that coordinate to provide certain functions, may execute computer readable instructions (e.g., a computer program) on the memory 32, which represents a tangible (non-transitory), machine-readable medium. The computer program may include logic that considers measurements from the sensor 38, which may represent multiple different sensors, and/or Internet system 37 and determines which tank or tanks of the fuel source 20 to place in fluid communication with the fluid passageways 34, 36, of the system 10 to generate the most desirable flame effect 17. The most desirable flame effect 17 may include flame effect factors related to color of the flame effect 17, brightness of the flame effect 17, cleanliness of the flame effect 17, cost-effectiveness of the flame effect 17, length of the flame effect 17, and/or safety of the flame effect 17, among other factors. The computer program executed by the processor 30 may take into account all, more, or a subset of the flame effect 17 factors described above. Additionally, the automation controller 28 may cooperate with different features of the system 10 (e.g., a pump, a compressor, a bank of different or backup nozzles and nozzle arrangements) to control different aspects of the flame. For example, if the automation controller 28 determines that more pressure is needed, a compressor may be activated or an ignition source prior to the entry of the nozzles 14, 16 may be activated. As another example, if the controller determines that the nozzles 14, 16 are likely not functioning properly (e.g., due to accumulation of soot), a valve may close off access to the nozzles 14, 16 and direct the fuels to a set of backup nozzles. In yet another embodiment, a bank of different nozzles that provide different flame characteristics may be selected for operation by the automation controller 28 based on sensor date (e.g., certain nozzles may be preferred for windy conditions).

Continuing with the illustrated embodiment, the automation controller 28 is configured to open and/or close control valves 42, 44, one for each of the inner nozzle 14 and the outer nozzle 16, respectively, to enable or block fluid flow through the fuel passageways 34, 36 to the inner nozzle 14 and the outer nozzle 16, respectively. The automation controller 28 may open and/or close the control valves 42, 44 based on measurements and/or information from the sensor 38 and Internet system 37 in the same manner as described above. In some embodiments, the automation controller 28 may open or close one or both of the control valves 42, 44 to a certain finite extent to regulate pressure of the fuel sent to either of the fuel passageways 34, 36 from the fuel source 20. Alternatively or in combination with the above described controls aspect, the control valves 42, 44 may each include a regulator, or a regulator may be included in the fuel source 20, to regulate pressure. The automation controller 28 may be instructed via the processor 30 to control the regulator or the control valves 42, 44 in the manner described above. In other words, in general, the automation controller 28 may regulate pressure of the fuel being supplied to the fuel passageways 34, 36 (and, eventually, to the inner nozzle 14 and outer nozzle 16) based on environmental factors supplied by the sensor 38 and/or the Internet system 37. Further, pressure of the fuels delivered to the inner nozzle 14 and outer nozzle 16, respectively, may be different for each of the inner nozzle 14 and outer nozzle 16, depending on the desired flame effect. For example, to achieve approximately a 30 to 40 foot (9.1 to 12.2 meter) flame, pressure (e.g., measured in pounds per square inch (psi) and kilopascals (kPa)) of natural gas delivered to the inner nozzle 14 may, for example, range from 10 to 40 psi (69 to 276 kPa), 20 to 30 psi (138 to 207 kPa), or 22 to 28 psi (152 to 193 kPa), and pressure of propane delivered to the outer nozzle 16, for example, may range from 1 to 20 psi (7 to 138 kPa), 5 to 15 psi (34 to 103 kPa), or 7 to 11 psi (48 to 76 kPa). It should be noted that, in some embodiments, a pulsed flame effect 17 may be achieved by delivering fuels at the above pressures or otherwise to the inner and outer nozzles 14, 16 in pulses. For example, the automation controller 28 may instruct the fuel source 20 (e.g., via regulators or via the control valves 42, 44) to supply propane to the outer nozzle 16 and natural gas to the inner nozzle 14 at a constant pressure in five second intervals, separated by three second intervals of cutting off the fuel source (e.g., via regulators or via the control valves 42, 44). This may result in the flame effect 17 being visible in repeated five second intervals, each separated by three second intervals. Between intervals, the automation controller 28 may cause an inert gas to pass through both nozzles 14, 16 to rapidly extinguish residual flame. The inert gas, in some embodiments, may also be used to discharge debris, including soot and ash, away from the nozzle assembly 12 to prevent building up within the nozzles 14, 16 and surrounding equipment or objects. In other words, the inert gas would not only extinguish residual flame, but may also be used to clear soot and ash already within the nozzles 14, 16 away from the flame effect system 10 in general.

Further to the discussion above, the sensor 38 disposed in the environment 40 and the Internet system 37 or other devices or communication systems may be configured to detect and/or supply data regarding a number of various environmental factors of the environment 40 to the automation controller 28, including environmental brightness (e.g., sunlight), brightness of the flame effect 17, pollution, temperature, wind conditions, and weather, among others. For example, the sensor 38 may detect that the environment 40 is relatively bright, and may provide information related to the brightness of the environment 40 to the automation controller 28. The automation controller 28 may perform logic based on the information received from the sensor 38 provide output to place the first tank 22 (having propane) of the fuel source 30 in fluid communication with the second fluid passageway 36 and the second fuel tank 24 (having natural gas) of the fuel source 30 in fluid communication with the first fluid passageway 34. The automation controller 28 may also instruct the control valves 42, 44 to open fully, such that the first fuel tank 22 is fluidly coupled to the outer nozzle 16 and the second fuel tank 24 is fluidly coupled to the inner nozzle 14, where the propane is supplied to the outer nozzle 16 with the same or different pressure and flow rate as the natural gas being supplied to the inner nozzle 14, depending on information received by the processor 30 from the sensor 38, Internet system 37, or some other input to the processor 30, and depending on the desired flame effect 17. The propane may be accelerated through the outer nozzle 16, and the natural gas may be accelerated through the inner nozzle 14. The gases may exit the nozzle assembly 12, pass over the pilot light of the igniter 18, and produce the visible flame effect 17, where the flame effect 17 achieves an optimal combination of brightness, cost-effectiveness, and cleanliness based on the environmental factors originally supplied to the processor 30, as described above.

It should be noted that, as indicated above, the processor 30 may execute a computer program (e.g., control logic) that takes into account inputs based on such factors as brightness, cost-effectiveness, and cleanliness of the flame effect 17. Further, the computer program may weight each of these factors, and other factors, based on a desired importance of such factors. Further, the automation controller 28 may control a type of fuel supplied to each fuel passageway 24, 26 (and, thus to either nozzle 14, 16), and/or a flow rate (and, thus pressure) of the types of fuel supplied to either fuel passageway 24, 26 (and, thus, to either nozzle 14, 16). For example, in one embodiment, on a bright day, the controller 28 may instruct the above actions to ensure that the flame effect 17 burns a clearly visible color during daylight, but still cost-effectively and cleanly. Alternatively, in another embodiment, on a dark day, the controller 28 may instruct the above actions to ensure that the flame effect 17 is clean and cost-effective, but still visible. Details regarding types of fuels supplied to the inner and outer nozzles 14, 16 and flow rate of said fuels, with respect to achieving a desirable flame effect 17, will be described in further detail below.

Figure 2:
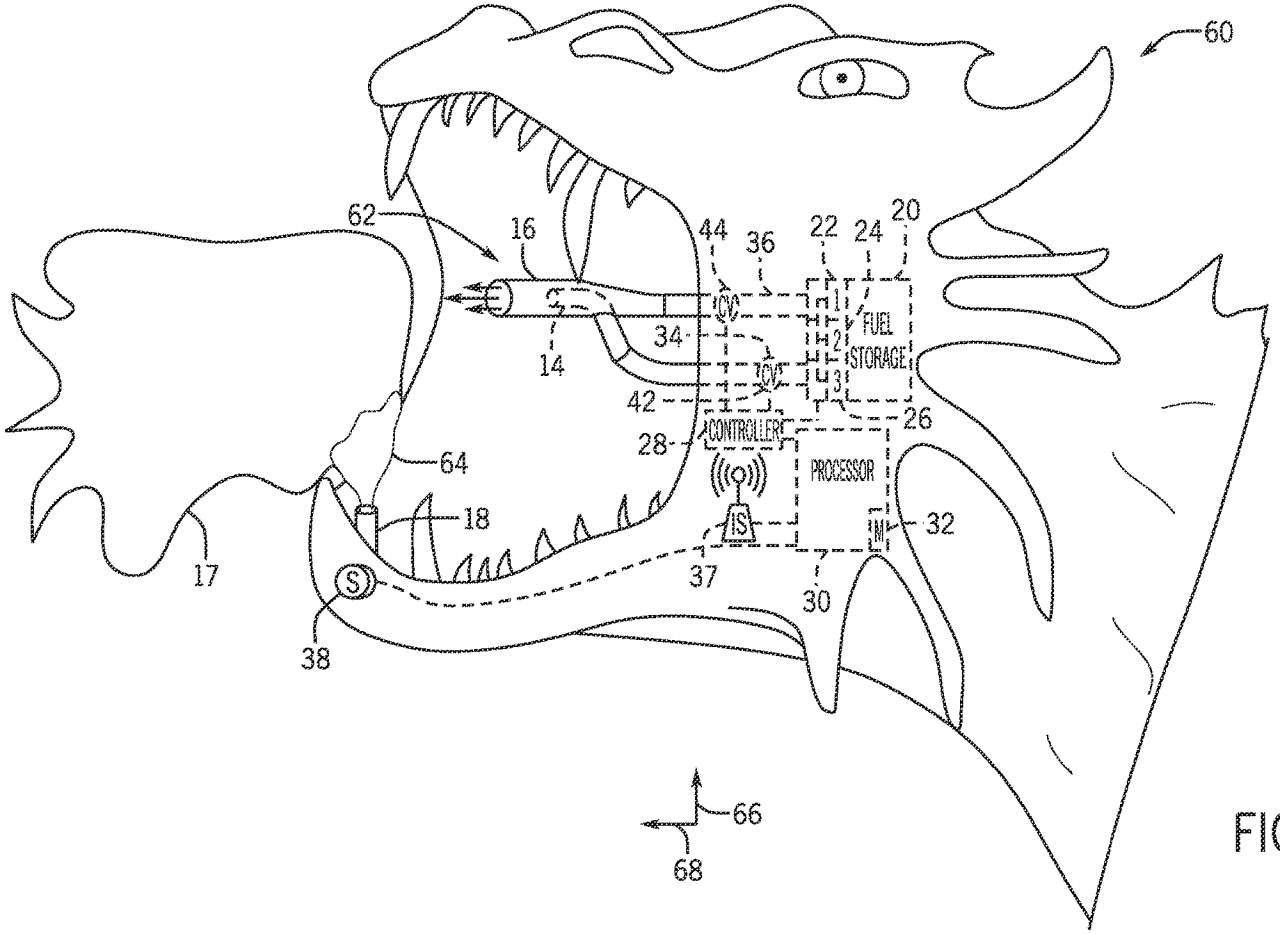
FIG. 2 is a perspective view of an embodiment including a portion of the flame effect system including a nested nozzle assembly and control system features integrated with a dragon model, in accordance with the present disclosure.

Turning now to FIG. 2, a perspective view of a portion of an embodiment of the system 10 and accompanying nozzle assembly 12 is shown disposed within a dragon model 60 (e.g., a statue or animatronic system). The system 10 may be at least partially hidden within the dragon model 60 (e.g., within a mouth 62 of the dragon 60), such that the flame effect 17 produced by the system 10 and the accompanying nozzle assembly 12 exits the mouth 62 of the dragon statue 60. In other words, the system 10 in combination with the dragon statue 60 may result in the intentional illusion of a fire-breathing (e.g., exhaling) dragon 60 for entertainment value.

In the illustrated embodiment, components of the system 10 are generally hidden within the mouth 62 of the dragon 60. For example, with reference to components described in FIG. 1, the fuel source 20, the controller 28, the control valves 42, 44, the internet system 37, the processor and memory 30, 32, and other components may be entirely hidden from view from a location external to the mouth 62 of the dragon 60. Certain components within the mouth 62 may be mounted onto an inner surface of the dragon 60 for positioning the system 10. For example, the fuel source 20 of the fuel may be mounted to a component of the dragon 60, such that the components directly and indirectly coupled (e.g., structurally coupled) to the fuel source 20 are also supported. Further, the nozzles 14, 16 may hang from a top of the mouth 62 of the dragon 60, or may be propped up by a component extending upwards from a bottom of the mouth 52 of the dragon 60 to the nozzles 14, 16. Further, the igniter 18 may include a pilot light 64, where the igniter 18 (e.g., blast pilot) extends upwards (e.g., in direction 66) from a bottom surface just inside the mouth 62 of the dragon 60 and, upon instruction from the burner controller 41 (as described above), releases the pilot light 64. In this way, the gaseous fuels accelerating out of the nozzles 14, 16 may pass over the pilot light 64 of the igniter 18 and continue out of the mouth 62 as the flame effect 17, generally in direction 68. In some embodiments, the flame effect 17 may measure, from the pilot light 64 in the mouth of the dragon 62 in direction 68, between approximately 10-60 feet (3-18 meters), 20-50 feet (6-15 meters), or 30-40 feet (9-12 meters). The distance of the flame effect 17 from the mouth 52 of the dragon 60 may be at least partially determined by the flow rate of the fuels being supplied to the fuel passageways 34, 36 (and, thus, the flow rate of the fuels being supplied to the inner nozzle 14 and outer nozzle 16), among other factors, where the flow rate and said other factors are controlled via the controller 28, as described above.

Figure 3:
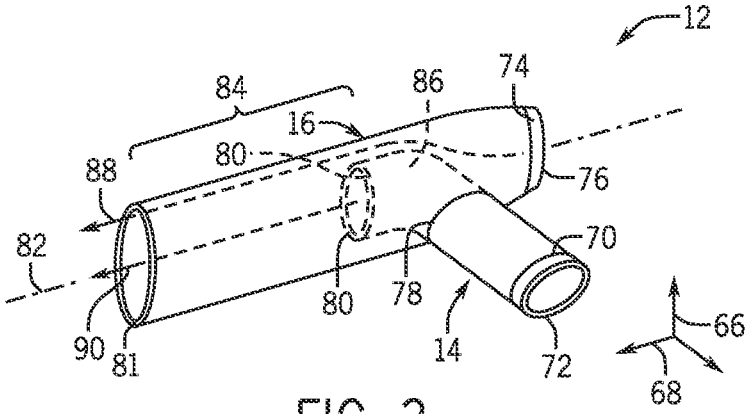
FIG. 3 is a perspective view of an embodiment of a nozzle assembly including nested nozzles, in accordance with the present disclosure.

Turning now to FIG. 3, a perspective view of the nozzle assembly 12 is shown with the inner nozzle 14 and the outer nozzle 16. The inner nozzle 14 may include a threaded portion 70 at an inlet 72 of the inner nozzle 14 for coupling the inner nozzle 14 to the corresponding control valve 42 or to a passageway (e.g., the passageway 34) extending between the inner nozzle 14 and the control valve 42. The outer nozzle 14 may also include a threaded portion 74 at an inlet 76 of the outer nozzle 16 for coupling the outer nozzle 16 to the corresponding control valve 44 or to a passageway (e.g., the passageway 36) extending between the outer nozzle 16 and the control valve 44.

In the illustrated embodiment, the inner nozzle 14 extends into a side 78 of the outer nozzle 16 and curves into a substantially concentric orientation (e.g., relative to the outer nozzle 16) within the outer nozzle 16. In other words, at least an outlet 80 of the inner nozzle 14, in the illustrated embodiment, is substantially concentric with an outlet 81 of the outer nozzle 16 about a longitudinal axis 82 extending generally in direction 68 within the nozzle assembly 12. In another embodiment, the outlet 81 and the outlet 80 may not be substantially concentric, but the cross sectional profile of the outlets 80, 81 may be substantially parallel to a single plane (e.g., a plane perpendicular to direction 68). In other words, in some embodiments, the outlet 81 and the outlet 80 may be nested (e.g., for at least a portion) but may not be substantially concentric. For example, the outlets 80, 81 may be axially symmetric and/or planar symmetric. Further, in the illustrated embodiment, the outlet 80 of the inner nozzle 14 is offset from the outlet 81 of the outer nozzle 16 along the longitudinal axis 82 by an offset distance 84. Technical effects of the substantial concentricity and offset distance 84 of the nozzle assembly 12 are described below.

As previously described, gaseous fuels or other fluids (e.g., non-combustible fluids or inert gases) are accelerated through both the inner nozzle 14 and the outer nozzle 16. For example, fuel enters the outer nozzle 16 at the inlet 76 of the outer nozzle 16. The fuel accelerates through the outer nozzle 16 and approaches an outer surface 86 of the inner nozzle 14, which may partially disrupt the flow of the fuel (e.g., fluid) through the outer nozzle 16. However, the outlet 80 of the inner nozzle 14 is offset the offset distance 84 from the outlet 81 of the outer nozzle 16. Accordingly, the flow of the fuel within the outer nozzle 16 may at least partially recover and/or accelerate in the nozzle assembly 12 before exiting the outlet 81 of the outer nozzle 16. In other words, when the flow of the fuel within the outer nozzle 16 passes over the inner nozzle 14, the flow may be disrupted and may become more turbulent. After passing the outlet 80 of the inner nozzle 14, the flow of the fuel from the outer nozzle 16 passing the outlet 80 of the inner nozzle 14 may partially recover (e.g., become less turbulent) due to (a) radially outward pressure against the fuel (e.g., the fuel supplied to the outer nozzle 16) by the flow of fuel exiting the outlet 80 of the inner nozzle 14 (e.g., the fuel supplied to the inner nozzle 14) and (b) radially inward pressure against the fuel (e.g., the fuel supplied to the outer nozzle 16) by the structure of the outer nozzle 16 itself.

Further, as indicated above, fluid enters the inner nozzle 14 through the inlet 72 of the inner nozzle 14 and curves into, for example, the substantially concentric portion of the inner nozzle 14 within the outer nozzle 16 or a least a portion that substantially shares a flow path direction with the outer nozzle 16. The fuel accelerates through the inner nozzle 14 and exits at the outlet 80 of the inner nozzle 14 into a portion of the outer nozzle 16. Accordingly, the fuel accelerating through the outer nozzle 16 may form a substantially annular layer 88 about the fuel flowing out of the inner nozzle 14 and into the outer nozzle 16. As described above, the fuel in the annular layer 88 may at least partially recover after being disrupted by the obstacle presented by the inner nozzle 14 due to inward pressure from the outer nozzle 16 itself and outward pressure via a cylindrical flow body 90 of fuel exiting the inner nozzle 14. In other words, the annular layer 88 may surround or envelop the substantially cylindrical flow body 90 (e.g., in volumetric terms). The cylindrical flow body 90 and the annular layer 88 may actually be warped or curvilinear due to the convergence and divergence of the outer nozzle 16. Further, in some embodiments, the cylindrical flow body 90 and the annular layer 88 may mix fully or to a finite extent due to the configuration of the outer nozzle 16 through which the annular layer 88 flows and through which the cylindrical flow body 90 flows after exiting the inner nozzle 14. Accordingly, it should be understand that the annular layer 88 and the cylindrical flow body 90 within the outer nozzle 16 downstream of the outlet 80 of the inner nozzle 14 may generally conform to the shape of the outer nozzle 16 downstream of the outlet 80 of the inner nozzle 14 or, in some embodiments, may mix due to the shape of the outer nozzle 16 downstream the outlet 80 of the inner nozzle 14. Thus, it should be recognized that variations of a "annular layer" and/or "cylindrical flow body" geometry (e.g., relative to the flow of the fluids through the nozzle assembly 12) may occur, but that said terms "annular layer" and/or "cylindrical flow body" are indicative of the general shape of the flow of fluid in one embodiment coming from the outer nozzle 16 and the inner nozzle 14, respectively. The various embodiments pertaining to the configuration of and effect of fluid flowing through the nozzles 14, 16 will be discussed in greater detail below.

Continuing with the illustrated embodiment, the annular layer 88 may include a first type of fuel (or other fluid) and the cylindrical flow body 90 may include a second, different type of fuel (or other fluid), as previously described. It should be noted that the fluid flowing through the outer nozzle 16 before reaching the inner nozzle 14 at the point where the inner nozzle 14 enters the outer nozzle 16 may actually flow through the entirety of the outer nozzle 16 and, thus, would not be an "annular film" until the inner nozzle 14 intersects into the outer nozzle 16. The fuel or fluid that makes up the annular layer 88 and the fuel or fluid that makes up the cylindrical flow body 90 may be determined based on environmental factors, as previously described, measured by the sensor 38 and relayed through the processor 30 to instruct the automation controller 28 to, for example, adjust fuel sources 22 and 24 and control valves 42 and 44 accordingly (e.g., as illustrated in FIGS. 1 and 2). For example, in one embodiment, the annular layer 88 (e.g., of the outer nozzle 16) includes propane, which generally burns more visibly in daylight than other combustible fuels (e.g., natural gas). The cylindrical flow body 90 (e.g., originating in the inner nozzle 14), for example, may include natural gas, which generally burns less visibly during daylight but is cleaner and less expensive than other combustible fuels (e.g., propane). In this way, on a bright day, the flame effect 17 produced by the nozzle assembly 12 may include a clearly visible, burning annular layer 88 around a cleaner burning, less expensive, cylindrical flow body 90. In another embodiment, the annular layer 88 and the cylindrical flow body 90 may actually mix within the outer nozzle 16 downstream the outlet 80 of the inner nozzle 14. Accordingly, the flame effect 17 may be bright and clean burning, but may not necessarily include a bright burning outer layer (e.g., sheath) and a clean burning inner portion, but may rather be substantially mixed such the entire flame effect 17 is bright and colorful while also maintaining cleanliness.

In another embodiment, the annular layer 88 may include the natural gas and the cylindrical flow body 90 may include the propane, which results in a clearly visible burning cylindrical flow body 90 and a cleaner burning, less expensive, annular layer 88. Alternatively, the two portions of fluids may mix thoroughly, as described above. Further, in any of the embodiments described above, natural gas is generally more buoyant than propane, which may enable the cleaner burning natural gas to "carry" the combusted or burned propane pollutants a distance such that the propane pollutants may be distributed and/or dissipated over the distance as it mixes with air, as opposed to the propane pollutant being concentrated (e.g., deposited) in a particular area. As previously described, the type of fuel chosen for each nozzle 14, 16, may be instructed via the automation controller 28 based on environmental factors measured by, and relayed from, the sensor 38 and/or the Internet system 37. Further, respective pressures (and, thus, respective flow rates) of the fuel in the annular layers 88 and the fuel in the cylindrical flow body 90 may be enabled via instruction of the automation controller 28, as previously described, to optimize the flame effect 17 based on the computer program executed by the processor 30.

Figure 4:
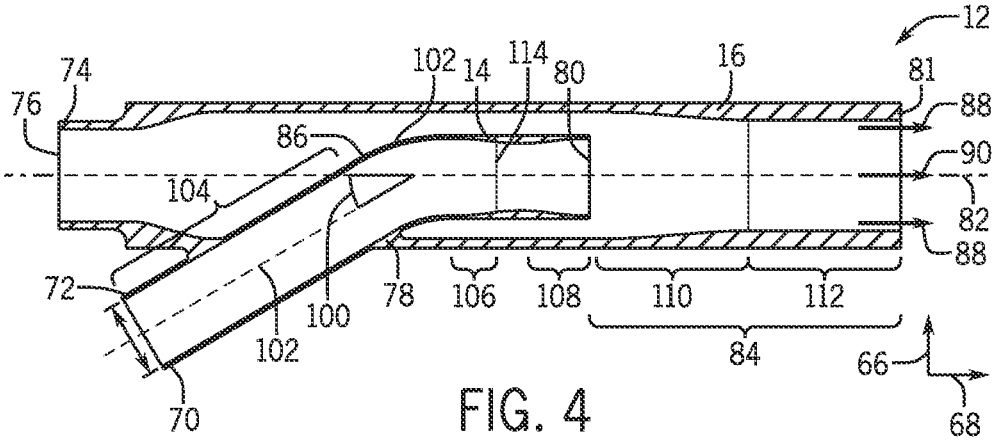
FIG. 4 is a cross-sectional view of an embodiment of a nozzle assembly including nested convergent-divergent nozzles, in accordance with the present disclosure.

Turning now to FIG. 4, an embodiment of the nozzle assembly 12 is illustrated in a cross-sectional side view. Specifically, in the embodiment illustrated by FIG. 4, the nozzles 14, 16 are Laval nozzles. In the illustrated embodiment, the inner nozzle 14 enters into the side 78 of the outer nozzle 16 at an angle 100, where the angle 100 is measured between a longitudinal axis 102 of an entry portion 104 of the inner nozzle 14 and the longitudinal axis 82 of the nozzle assembly 12. The angle 100 may be between approximately 20 and 70 degrees, 30 and 60 degrees, 40 and 50 degrees, or 43 and 47 degrees. The angle 100 may be determined during design based on a number of factors. For example, the angle 100 may be obtuse to enable a better flow through the inner nozzle 14. In other words, with an obtuse angle 100, the inner nozzle 14 includes a more gradual curve 102 within the outer nozzle 16, which may enable improved flow through the inner nozzle 14. However, by including the obtuse angle 100, the entry portion 104 of the inner nozzle 14 may be longer and present a larger obstacle for the flow within the outer nozzle 16 to overcome. Alternatively, with an acute angle 100, the entry portion 104 is shorter and presents a smaller obstacle for the flow within the outer nozzle 16 to overcome, but the flow within the inner nozzle 14 may experience increased turbulent flow due to the abrupt directional flow change. Further, the offset distance 84 may affect the optimal angle 100, because with a greater offset distance 84, the annular film 88 has a greater distance to recover from the flow obstacle presented by the entry portion 104 of the inner nozzle 14. Thus, in some embodiments, the offset distance 84 may be longer and the angle 100 more acute, which enables improved flow through the inner nozzle 14 and a greater distance for the flow through the outer nozzle 16 (e.g., the annular film 88) to recover.

Continuing with FIG. 4, both the inner nozzle 14 and the outer nozzle 16, as previously described, converge in one portion and diverge in another portion. For example, the inner nozzle 14 includes a converging portion 106 and a diverging portion 108 and the outer nozzle 16 includes a converging portion 110 and a diverging portion 112. Between the converging and diverging portions 106, 108 of the inner nozzle 14 is a throat 114 of the inner nozzle 14. Between the converging and diverging portions 110, 112 of the outer nozzle 16 is a throat 116 of the outer nozzle 16. In the illustrated embodiment, the outlet 80 of the inner nozzle 14 is disposed adjacent the beginning of the converging portion 110 of the outer nozzle 16. In other words, in some embodiments, the offset distance 84 may substantially correspond with a length of the converging portion 110 and the diverging portion 112 of the outer nozzle combined. This may enable at least partial recovery of the annular layer 88 in the outer nozzle 16 within the converging and diverging portions 110, 112 of the outer nozzle 16. Alternatively, in some embodiments, this may provide a larger distance within the outer nozzle 16 (e.g., measured from the outlet 80 of the inner nozzle 14 to the outlet 81 of the outer nozzle 16) through which the gases (e.g., the annular layer 88 and the cylindrical flow body 90) may mix.

Figure 5:
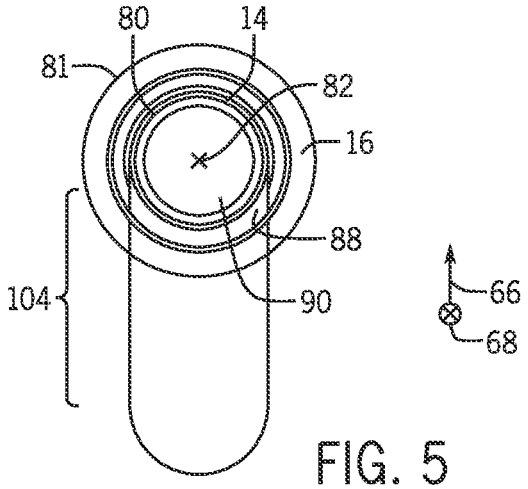
FIG. 5 is a front view of the nozzle assembly of FIG. 4, in accordance with the present disclosure.

An embodiment of the nozzle assembly 12 is shown in a front view illustration in FIG. 5. In the illustrated embodiment, the outlet 80 of the inner nozzle 14 is substantially concentric with the outlet 81 of the outer nozzle 16 about the longitudinal axis 82. During operation, the annular layer 88 will be between the outer nozzle 16 and the inner nozzle 14, and the cylindrical flow body 90 exits the inner nozzle 14 and includes a cross-section within the outer nozzle 16 substantially equal to the cross-section of the outlet 80 of the inner nozzle 14. However, it should be noted that cross sections of the annular layer 88 and the cylindrical flow body 90 taken at one point within the outer nozzle 16 along the longitudinal axis 82 may not be exactly the same as cross sections of the annular layer 88 and the cylindrical flow body 90, respectively, at another point within the outer nozzle 16 along the longitudinal axis 82. Differences between the cross-sections may occur due to the convergence and divergence of the outer nozzle 16, which decreases and increases the cross-sectional area, respectively, of the outer nozzle 16. Differences between the cross-sections may also occur due to the inner nozzle 14 interrupting flow in the outer nozzle 16 downstream the converging and diverging portions 110, 112 (as shown in FIG. 4) of the outer nozzle 16. Further, as described above, the annular layer 88 and the cylindrical flow body 90 may mix in some embodiments due to the contour of the outer nozzle 16 downstream the inlet 80 of the inner nozzle 14.

Figure 6:
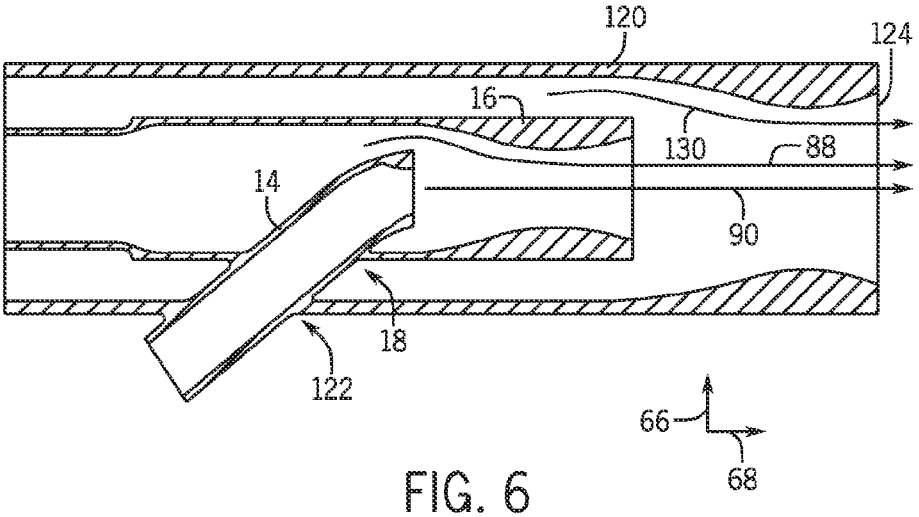
FIG. 6 is a cross-sectional view of an embodiment of a nozzle assembly including three nozzles in a nested arrangement, in accordance with the present disclosure.
Figure 7:
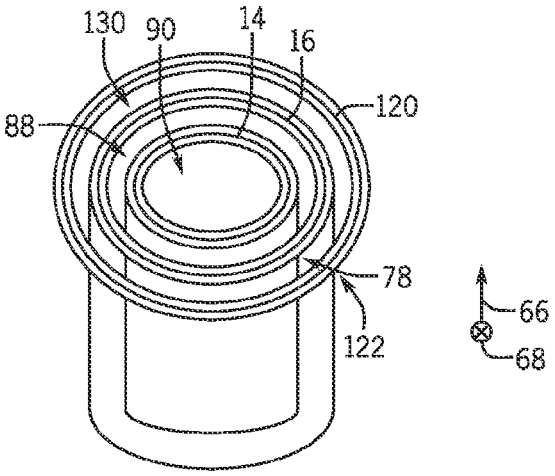
FIG. 7 is a front view of the nozzle assembly of FIG. 6, in accordance with the present disclosure.

Although embodiments of the nozzle assembly 12 described above include the inner nozzle 14 and the outer nozzle 16, some embodiments may include more than two nozzles. For example, an embodiment of the nozzle assembly 12 having three nozzles is illustrated in a cross-sectional side view in FIG. 6 and a front view in FIG. 7. In the illustrated embodiments, the inner nozzle 14 and the outer nozzle 16 are both disposed within a third nozzle 120. The inner nozzle 14 may enter into a side 122 of the third nozzle 120 in the same way the inner nozzle enters the side 78 of the outer nozzle 16. The outer nozzle 120 may be coupled to the same fuel source (e.g., the fuel source 20) as the inner nozzle 14 and the outer nozzle 16. In the illustrated embodiment, each nozzle 14, 16, 120 may include a different type of fuel. For example, the inner nozzle 14 may include natural gas, the outer nozzle 16 may include propane, and the third nozzle 120 may include nitrogen, which may serve to "carry" pollutants from, for example, burned propane a distance from the nozzle assembly 12 after exiting the nozzle assembly 12, as similarly described above with reference to the natural gas. In this way, the fuel exiting an outlet 124 of the third nozzle 120 (e.g., after passing through a converging portion 126 and diverging portion 128 of the third nozzle 120) may include the cylindrical flow body 90, the annular layer 88, and a second annular layer 130 radially adjacent to and surrounding the annular film 88. As previously described, the cylindrical flow body 90, the annular layer 88, and the second annular layer 130 may each include a different type of fuel relative to one another. For example, the cylindrical flow body 90 may include natural gas, the annular layer 88 may include propane, and the second annular layer 130 may include nitrogen. In another embodiment, the cylindrical flow body 90 may include nitrogen, the annular layer 88 may include natural gas, and the second annular layer 130 may include propane. Any fuel or fluid may be used for any of the three nozzles depending on the desired flame effect 17.

Figure 8:
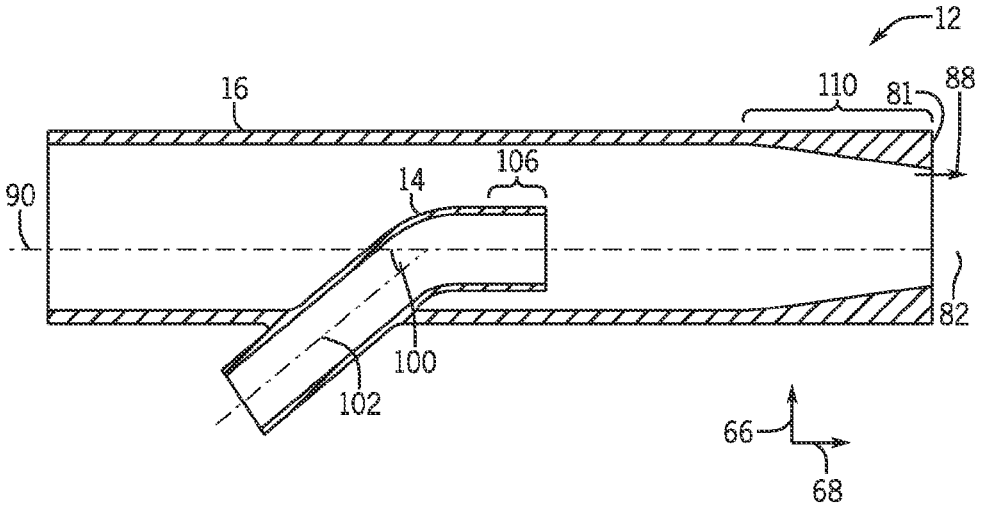
FIG. 8 is a cross-sectional view of an embodiment of a nozzle assembly including two converging nozzles, in accordance with the present disclosure.
Figure 9:
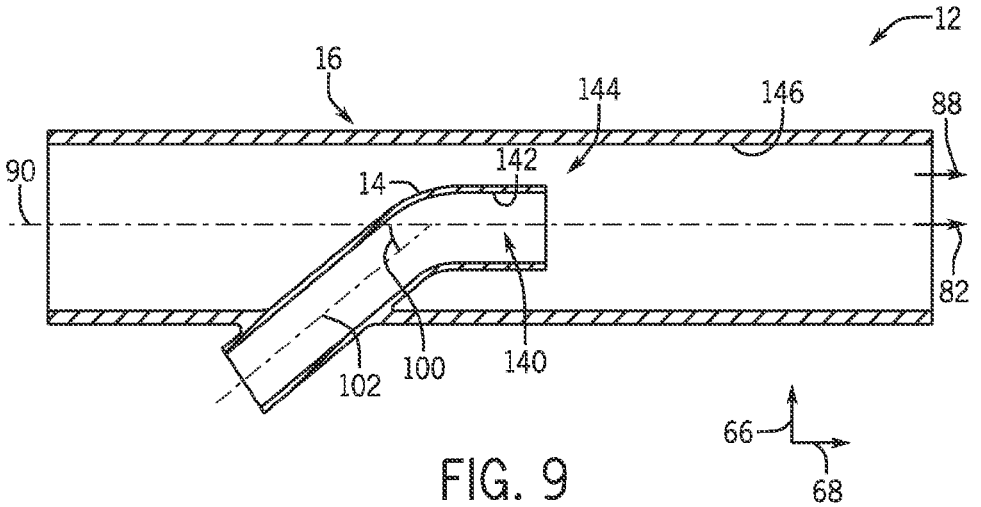
FIG. 9 is a cross-sectional view of an embodiment of a nozzle assembly including two substantially straight walled nozzles, in accordance with the present disclosure.

It should be noted that while certain embodiments of the nozzles are illustrated as including converging-diverging nozzles, in other embodiments variations of the nozzle types might be employed. For example, some may be simply converging or include substantially consistent (parallel) walls. In FIG. 8, an embodiment of the nozzle assembly 12 is shown having the inner nozzle 14 and the outer nozzle 16, where the inner nozzle 14 and the outer nozzle 16 are converging nozzles. In other words, the inner nozzle 14 includes the converging portion 106 and the outer nozzle 16 includes the converging portion 110. Neither nozzle 14, 16, in the illustrated embodiment, includes a diverging portion. The converging portions 106, 110 may accelerate fuel through each respective nozzle 14, 16, and the fuels exit the nozzle assembly 12 through the outlet 81 of the outer nozzle 16. In FIG. 9, an embodiment of the nozzle assembly 12 is shown having the inner nozzle 14 and the outer nozzle 16, where the inner nozzle 14 and the outer nozzle 16 are substantially consistent (parallel) straight walled nozzles. In other words, an inner portion 140 of the inner nozzle 14 is substantially cylindrical, where an inner surface 142 of the inner portion 140 of the inner nozzle 14 extends substantially in direction 68, parallel with the longitudinal axis 90. Additionally, an inner portion 144 of the outer nozzle 16 is substantially cylindrical, where an inner surface 146 of the inner portion 144 of the outer nozzle 16 extends substantially in direction 68, parallel with the longitudinal axis 90. In general, the contours of the various nozzles 14, 16, as well as the offset or offsets (e.g., offset distance 84) between the outlets 80, 81 of the nozzles 14, 16, respectively, may be selected depending on the desired flame effect 17. For example, if the desired flame effect 17 requires that the gases from the inner nozzle 14 and the outer nozzle 16 mix within the nozzle assembly 12, appropriate contours of the inner and outer nozzles 16 and an appropriate offset distance 84 may be selected accordingly. If the desired flame effect 17 requires that the gases from the inner nozzle 14 and the outer nozzle 16 remain separate (e.g., by maintaining substantially the annular film 88 and cylindrical body flow 90 through the nozzle assembly 12), the appropriate contours of the inner and outer nozzles 16 and the offset distance 84 may be selected accordingly.

Figure 10:
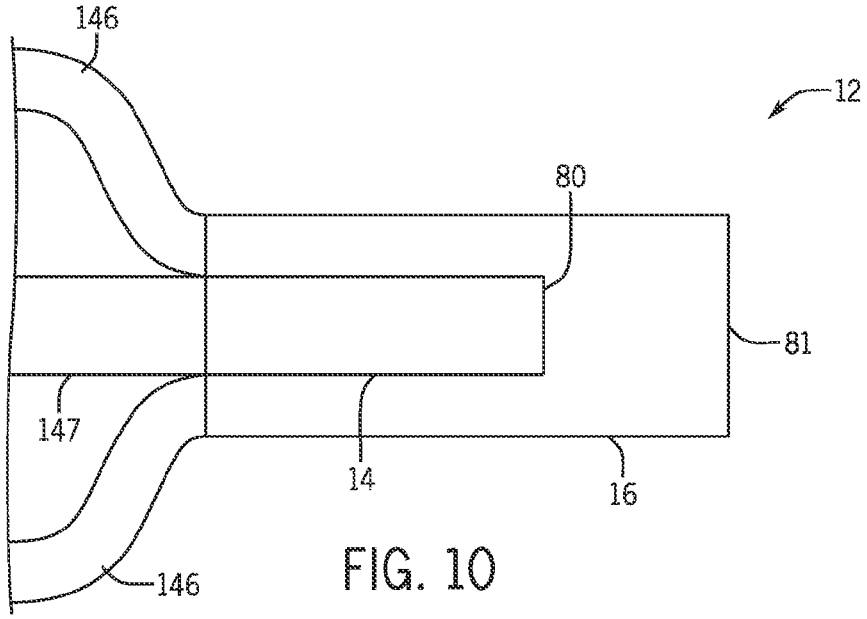
FIG. 10 is a cross-sectional view of an embodiment of a nozzle assembly including two nested nozzles, in accordance with the present disclosure.
Figure 11:
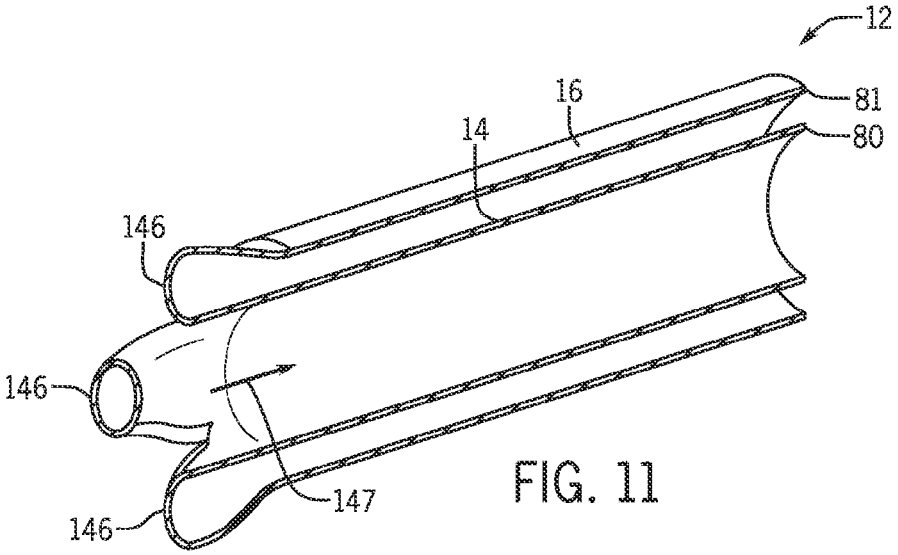
FIG. 11 is a perspective view of an embodiment of a nozzle assembly including two nested nozzles, in accordance with the present disclosure.

It should also be noted that, in other embodiments, the fluid passageways of the nozzles may be coupled together or attached in some other manner. One such embodiment is illustrated in FIG. 10, which is a cross-sectional representation of the inner and outer nozzles 14, 16 in a particular geometry. In the illustrated embodiment, one or more fuel passageways (e.g., passageways 146), which are coupled to the fuel source 20 (not shown), may each carry a different type of fuel or fluid to the outer nozzle 16. Or, each of the passageways 146 may carry the same fuel or fluid to the outer nozzle 16. In the illustrated embodiment, an inner passageway 147 is coupled to the inner nozzle 14, and supplies fuel or fluid from the fuel source 20 (not shown) to the inner nozzle 14. The nozzle assembly 12 may then pass the fuels through each of the nozzles 14, 16 such that the fuels exit at the outlet 81 of the outer nozzle 16 and pass over the pilot light 64 of the igniter 18 for generating the flame effect 17. FIG. 11 shows a perspective cross-sectional view of inner and outer nozzles 14, 16 with similar features.

Other embodiments may also exist. For example, in one embodiment, the nozzle assembly 12 may only include a single nozzle, where a fuel or fluid passageway is coupled to the back of the nozzle and a series of smaller fuel passageways may enter into a sidewall of the nozzle and terminate at the sidewall. As such, fuel or fluid passing through the smaller fuel passageways may inject directly into the nozzle from the sidewall into the stream of the fuel or fluid being routed through the nozzle from the back of the nozzle.

As described above, any combustible or non combustible gas may be used for any one of the nozzles 14, 16, 120 described heretofore, and said combustible or non combustible gas selected for each nozzle 14, 16, 120 from the fuel source may be determined based on measurements taken by the sensor 38 or provided to the processor 30 by the Internet system 37 relating to environmental factors. The particular type of gas (e.g., fuel) accelerated through each nozzle 14, 16, 120 may include desirable characteristics based on the measurements taken by or provided by the sensor 36 and/or Internet systems 38, 40. For example, as previously described, propane may be selected for one of the nozzles 14, 16, 120 to provide a visible flame effect 17 that can be seen during daylight. Natural gas may be selected for one of the nozzles 14, 16, 120 for cleanliness and/or cost related concerns. In particular, natural gas may be selected at night, because burning natural gas is generally visible in the dark and is more cost-effective and clean than propane, which is generally visible during the day and night. Additionally, as previously described, a mass flow rate (and, thus pressure) of any one of the fuels traveling through any one of the nozzles 14, 16, 120 may be increased or decreased via action resulting from output from controller 28 to one or more system actuators (e.g., control valves).

Figure 12:
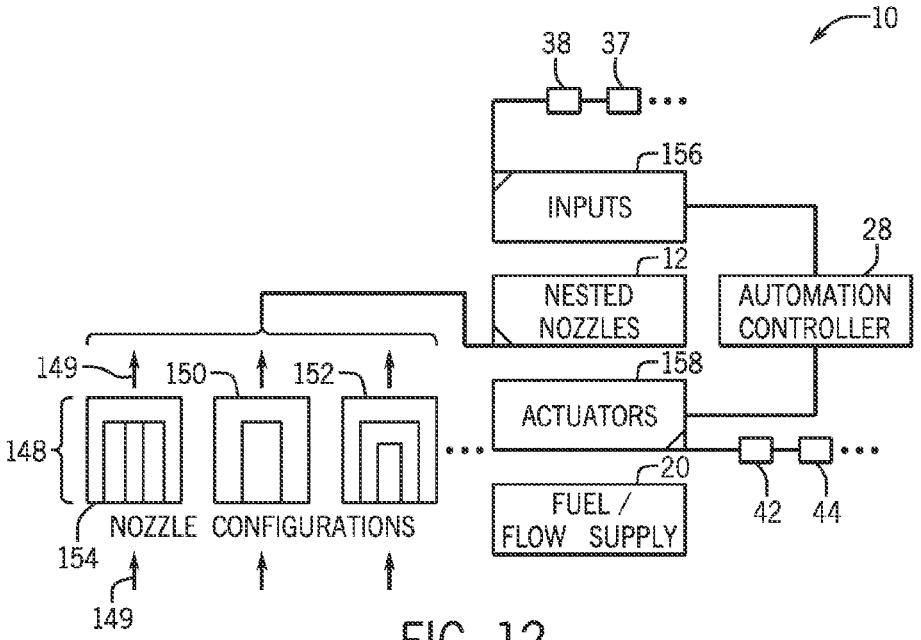
FIG. 12 is a schematic block diagram of a nozzle assembly, in accordance with the present disclosure.

It should be noted that certain elements in the previously illustrated embodiments may include some variations not already described. For example, a schematic diagram is shown in FIG. 12 to provide a basic illustration of the system 10 and the nozzle assembly 12. In the illustrated embodiment, a number of configurations 148 of the nozzle assembly 12 are shown having nested nozzles with respective gas flow paths indicated by arrows 149. In some embodiments, as indicated by a first configuration 150, two nozzles may be in a substantially concentric orientation 150 and an exit of the outer nozzle may be farther along the gas flow path 149 than the exit of the inner nozzle. In other embodiments, as generally represented by a second orientation 152, three or more nozzles may be in a substantially concentric orientation and each respective nozzle from the second innermost to the outermost may have an exit that extends farther along the gas flow path 149 than that of the nozzle or nozzles nested therein. In still other embodiments, as generally represented by a third orientation 154, a number of nozzles may be nested within one another and certain nozzles may have exits that are aligned. In yet other embodiments, nozzles that are nested within a nozzle may have an exit that extends further along the gas flow path 149 than the nozzle in which they are nested. In accordance with the present disclosure, any orientation and number of nested nozzles may be used for the nozzle assembly 12.

In some embodiments, each nozzle may include converging and diverging portions, as previously discussed, to facilitate acceleration of the hot gasses passing through the particular nozzle. However, other embodiments may include nozzles with only a converging portion, only a diverging portion, only a straight walled (e.g., substantially cylindrical) portion, or some other combination of the described portions. Also, while there is an offset between outlets of nested nozzles in the illustrated embodiments, in some embodiments, nozzle outlets may be substantially aligned. For example, two inner nozzles may have aligned outlets but remain offset relative to an outermost nozzle that has an outlet extending past the outlet of the innermost nozzles.

Further, the nozzles may be configured to receive inserts, such that an insert may be manually inserted into either of the nozzles to redefine the nozzles. For example, a nozzle with a converging portion and a diverging portion may, based on the desired flame effect 17, receive an insert with only a converging portion to temporarily redefine the nozzle as a nozzle with only a converging portion. The nozzle with the insert may be utilized until it is determined that the desired flame effect 17 may benefit from a nozzle with both a converging and diverging, at which point the insert may be removed. It should be noted that the initial configuration of the nozzle may include only a converging portion or both a converging and diverging portion, and that the insert may include only a converging portion or both a converging and diverging portion. Further, the insert may include the same types of portions (e.g., converging and/or diverging) as the initial nozzle, but the dimensions (e.g., cross-sectional area, slope) of the various portions may be different for the insert and may enhance the flame effect 17 in some way in certain conditions (e.g., based on environmental factors). Further still, the initial nozzle, the insert, or both may include a straight walled (e.g., substantially cylindrical) portion, as previously described. Also, various different nozzles and/or nozzle inserts may be provided as nozzle banks that can be alternated in and out of use by redirecting fuel flow or maneuvering the bank of nozzles. In other words, the different nozzles and/or nozzle inserts may be automatically placed into the nozzle assembly 12 via regulation by the automation controller 28, which may determine the appropriate nozzle and/or insert based on environmental factors received by the automation controller 28 in addition to determining the appropriate fuel source for each nozzle and the appropriate pressure for each fuel source, as previously described. In some embodiments, multiple controllers may be used, where each controller controls one or more of the components described above, and each controller may receive instructions for the same or different processors, where each processor receives measurements from the same or different sensors and/or Internet systems.

Continuing with FIG. 12, the automation controller 28 may include or be coupled to one or more inputs 156. The inputs 156 may include measurements of the environmental factors measured by the sensor 38 and values of the environmental factors provided as provided by the Internet system 37. The environmental factors may include environmental brightness, flame brightness, environmental pollution, flame soot levels, weather, wind conditions, time of day, and/or humidity. Further, the inputs 156 may be analog and/or digital inputs.

The automation controller 28 may also include or be coupled to one or more actuators 158, where the automated controller 28 provides instructions to the actuators 158 for regulating the actuators 158. The actuators 158 may include valves, regulators, pumps, igniters, or other features for actuating various features of the system 10. The actuators 158 may include actuators 158 upstream of the nozzle assembly 12 and actuators 158 downstream of the nozzle assembly 12. For example, upstream of the nozzle assembly 12, the actuators 158 may include a rotator configured to rotate the fuel source 20 about a bearing, where the bearing is physically coupled to two or more fuel tanks of the fuel source 20. By rotating the fuel source 20 about the bearing, one of the two or more fuel tanks of the fuel source 20 may be fluidly coupled to a conduit leading to one of the nozzles. In other embodiments, a different type of actuator 158 may be used to couple the appropriate fuel type to the appropriate nozzle. Further, upstream of the nozzle assembly 12, the actuators 158 may include a regulatory device for regulating pressures (e.g., supply pressures) of the fuel types as they are delivered to the appropriate nozzles. For example, the actuators 158 may include a pump configured to pump fuel to the nozzles at a certain pressure. Other actuators 158 may be included for actuating other portions of the system 10 upstream the nozzle assembly 12, in accordance with the present disclosure.

Downstream of the nozzle assembly 12, one of the actuators 158 may be a fan configured to blow upwardly and/or at an angle on the flame effect 17, such that the soot generated by the flame effect 17 is blown away from the system 10 and dispersed over a distance as opposed to concentrated in one place near the system 10. In some embodiments, the ignition feature 18 may be considered as one of the actuators 158, and the automation controller 28 may control the ignition feature 18 to determine when to use the ignition feature 18. For example, in one embodiment, the ignition feature 18 is a flame, where the fuels passing through the nozzle assembly 12 pass over the flame. The automation controller 28 may control when the ignition feature 18 has a lit flame and when the ignition feature 18 does not have a lit flame. Further, one of the actuators 158 downstream the nozzle assembly 12 may include a rotator configured to rotate a bank of nozzles or nozzle inserts about a bearing, such that the appropriate nozzle or nozzle insert may be placed into the nozzle assembly 12, as previously described. Other actuators 158 may be included for actuating other portions of the system 10 downstream the nozzle assembly 12, in accordance with the present disclosure.

Figure 13:
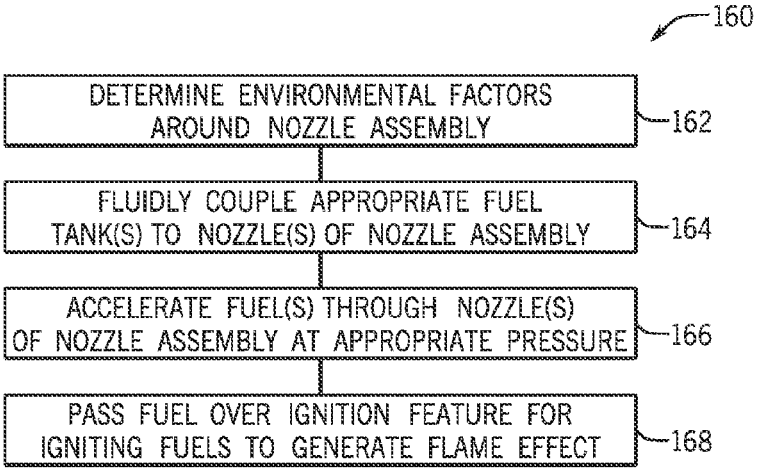
FIG. 13 is a method of operating a system including a nozzle assembly, in accordance with the present disclosure.

Turning now to FIG. 13, a process flow diagram illustrating a method 160 of operating the system 10 is shown. The method 160 includes determining (block 162) environmental factors around the nozzle assembly 12. As previously described, determining environmental factors around the nozzle assembly 12 may include measuring the environmental factors via the sensor 38 and providing the measurements to the automation controller 28. Further, the Internet system 37 may be used to provide values of the environmental factors to the automation controller 28. The method 160 also includes fluidly coupling (block 164) an appropriate fuel type or types from the fuel source 20 with each of the inner nozzle 14 and the outer nozzle 16, based on the environmental factors received by the automation controller 28. Further, the method 160 includes accelerating or passing (block 166) the fuel through the nozzles 14, 16 of the nozzle assembly 12 at appropriate respective pressures, which are determined and regulated by the automation controller 28 (e.g., via automated control of control valves, regulators, pumps) based on the environmental factors. Further still, the method 160 includes passing (block 168) the fuel over the ignition feature 18 (e.g., the flame) to generate the flame effect 17.

While only certain features have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A system, comprising:

a fuel source comprising a first tank for a first fuel and a second tank for a second fuel;

a nozzle assembly, comprising:

an outer nozzle defining an outer flow path configured to receive the first fuel from the first tank, wherein the first fuel comprises a first material composition; and an inner nozzle having a wall defining an inner flow path configured to receive the second fuel from the second tank, wherein at least a portion of the inner nozzle is nested within at least a portion of the outer nozzle such that the outer flow path of the outer nozzle contacts an outer surface of the wall of the inner nozzle, and wherein the second fuel comprises a second material composition different than the first material composition; and an ignition feature configured to receive and ignite the first fuel, the second fuel, or both to generate a flame effect, wherein the inner nozzle enters a sidewall of the outer nozzle at a non-90 degree angle with respect to a longitudinal axis of the outer nozzle, and wherein the inner nozzle comprises a bend located within the outer nozzle such that the inner nozzle comprises a longitudinal segment having an additional longitudinal axis parallel with the longitudinal axis of the outer nozzle.

2. The system of claim 1, wherein the fuel source is configured to supply the first fuel at a first pressure and the second fuel at a second pressure different than the first pressure.

3. The system of claim 1, comprising:

one or more actuators; and an automation controller configured to operate the one or more actuators to:

provide the first fuel to the outer nozzle by fluidly coupling the outer nozzle with the first tank;

regulate a first supply pressure of the first fuel;

provide the second fuel to the inner nozzle by fluidly coupling the inner nozzle with the second fuel tank; and regulate a second supply pressure of the second fuel.

4. The system of claim 3, wherein the automation controller is configured to operate the one or more actuators based on input from at least one sensor monitoring factors that affect an aesthetic of the flame effect.

5. The system of claim 1, comprising:

at least one actuator;

an automation controller configured to control operation of the at least one actuator; and at least one input device configured to provide data to the automation controller regarding factors affecting an aesthetic of the flame effect, wherein the automation controller is configured to control operation of the at least one actuator based on the provided data.

6. The system of claim 5, wherein the factors affecting the aesthetic of the flame effect comprise environmental brightness, flame brightness, weather, time of day, humidity, wind conditions, or a combination thereof.

7. The system of claim 5, wherein the at least one input device comprises a sensor configured to measure the factors affecting the aesthetic of the flame effect, a communication system configured to supply information related to the factors affecting the aesthetic of the flame effect, or a combination thereof.

8. The system of claim 5, wherein the at least one actuator operates to control fuel flow through one or both of the inner and outer nozzles, operates to control the ignition feature of the system, or a combination thereof.

9. The system of claim 1, wherein the first material composition comprises one of propane, natural gas, butane, ethane, or hydrogen, and wherein the second material composition comprises a different one of propane, natural gas, butane, ethane, or hydrogen than the first material composition.

10. A system, comprising:

a nozzle assembly configured to generate a flame effect visible from an exterior of the system, wherein the nozzle assembly comprises an ignition feature positioned proximate to an end of the nozzle assembly; and an automation controller configured to regulate fluid flows of a first fuel from a first tank and a second fuel from a second tank to a first nozzle and to a second nozzle of the nozzle assembly based at least in part on environmental factors surrounding the system that affect an aesthetic of the flame effect, wherein the automation controller is configured to regulate the fluid flows of the first fuel and the second fuel such that the first fuel and the second fuel pass over the ignition feature for ignition;

wherein the second nozzle comprises a longitudinal axis extending through a flow path of the second nozzle, wherein the first nozzle enters a sidewall of the second nozzle at a non-90 degree angle with respect to the longitudinal axis of the second nozzle, and wherein the first nozzle comprises a bend located within the second nozzle such that first nozzle comprises a longitudinal segment having an additional longitudinal axis parallel with the longitudinal axis of the second nozzle.

11. The system of claim 10, wherein at least a portion of the first nozzle is disposed within at least a portion of the second nozzle such that an outer surface of a wall that defines an additional flow path of the first nozzle contacts the flow path of the second nozzle.

12. The system of claim 11, wherein the portion of the first nozzle is substantially axially symmetric, planar symmetric, or both with the portion of the second nozzle.

13. The system of claim 10, wherein the automation controller is configured to instruct a fluid coupling of the first tank to the first nozzle and the second tank to the second nozzle based on the environmental factors surrounding the system.

14. The system of claim 10, comprising a sensor configured to measure the environmental factors and provide measurements to the automation controller.

15. The system of claim 10, comprising an Internet system configured to provide values of the environmental factors to the automation controller.

16. The system of claim 10, wherein the environmental factors comprise environmental brightness, flame brightness, weather, time of day, humidity, or a combination thereof.

17. The system of claim 10, wherein the first fuel and the second fuel comprise two or more separate fuel types including propane, natural gas, butane, ethane, hydrogen, or other combustible material normally existing in a vapor state at standard temperature and pressure.

18. A method of operating a nozzle system, the method comprising:

determining factors around the system;

fluidly coupling a first tank comprising a first fuel with a first nozzle and a second tank comprising a second fuel with a second nozzle, wherein the first fuel comprises a first material composition and the second fuel comprises a second material composition different than the first material composition;

passing the first fuel through the first nozzle at a first pressure and the second fuel through the second nozzle at a second pressure; and passing the first fuel and the second fuel over an ignition feature, such that the first fuel and the second fuel ignite to generate a flame effect visible from an exterior of the system;

wherein the second nozzle comprises a longitudinal axis extending through a flow path of the second nozzle, wherein the first nozzle enters a sidewall of the second nozzle at a non-90 degree angle with respect to the longitudinal axis of the second nozzle, and wherein the first nozzle comprises a bend located within the second nozzle such that first nozzle comprises a longitudinal segment having an additional longitudinal axis parallel with the longitudinal axis of the second nozzle.

19. The method of claim 18, comprising determining the first pressure, the second pressure, or a combination thereof via an automation controller based on measurements or values of the factors received by the automation controller.

20. The method of claim 18, comprising passing a third fuel, from a third tank, through a third nozzle in which the first and second nozzles are nested, wherein the third fuel comprises a third material composition different than the first material composition and the second material composition.

21. A system, comprising:

an outer housing structure;

a nozzle assembly configured to flow a first fuel and a second fuel through the nozzle assembly to facilitate generation of a flame effect from an outlet of the nozzle assembly, wherein the nozzle assembly is positioned within the outer housing structure such that the nozzle assembly is at least partially hidden within the outer housing structure and such that an end of the nozzle assembly is positioned proximate to an opening in the outer housing structure, wherein the opening in the outer housing structure is configured to expose the flame effect external to the outer housing structure; and an automation controller configured to regulate a flow of the first fuel and a flow of the second fuel to control desired aesthetic features of the flame effect;

a first nozzle of the nozzle assembly; and a second nozzle of the nozzle assembly, wherein a portion of the first nozzle is nested within the second nozzle;

wherein the second nozzle comprises a longitudinal axis extending through a flow path of the second nozzle, wherein the first nozzle enters a sidewall of the second nozzle at a non-90 degree angle with respect to the longitudinal axis of the second nozzle, and wherein the first nozzle comprises a bend located within the second nozzle such that first nozzle comprises a longitudinal segment having an additional longitudinal axis parallel with the longitudinal axis of the second nozzle.

* * * * *